United States Patent [19]

Comparetto

[11] Patent Number: 4,663,785

[45] Date of Patent: May 12, 1987

[54] TRANSPARENT-TRANSLUCENT FLUIDIC HEAD PROTECTOR

[76] Inventor: John E. Comparetto, 322 Freeman Ave., Audubon, Iowa 50025

[21] Appl. No.: 845,681

[22] Filed: Mar. 28, 1986

[51] Int. Cl.[4] ..... A42B 3/02

[52] U.S. Cl. ..... 2/413; 2/425

[58] Field of Search ..... 2/2, 9, 411, 413, 425, 2/424; 426/603

[56] References Cited

U.S. PATENT DOCUMENTS

| | | | |
|---|---|---|---|
| 600,778 | 3/1898 | Frazier | 2/413 |
| 2,295,279 | 9/1942 | Andrews | 2/424 X |
| 2,539,457 | 1/1951 | Metheny et al. | 426/603 X |
| 3,039,109 | 6/1962 | Simpson | 2/413 |
| 3,866,909 | 2/1975 | De Santis | 2/2 X |
| 4,124,904 | 11/1978 | Matthes | 2/413 |
| 4,222,122 | 9/1980 | Toms | 2/424 X |
| 4,233,689 | 11/1980 | Baron | 2/413 |

FOREIGN PATENT DOCUMENTS

| | | | |
|---|---|---|---|
| 2387611 | 12/1978 | France | 2/413 |

*Primary Examiner*—Louis K. Rimrodt

*Attorney, Agent, or Firm*—Shoemaker and Mattare, Ltd.

[57] ABSTRACT

A fluid filled head protector absorbs trauma with a safety valve and monitoring system.

12 Claims, 3 Drawing Figures

TRANSPARENT-TRANSLUCENT FLUIDIC HEAD PROTECTOR

BACKGROUND OF THE INVENTION

1. Field of the Invention

Protective head gear and helmets.

2. Description of the Prior Art

In the sport of boxing, the head gear is made of heavy foam padding or animal hair fill covered by animal hide or vinyl. In other contact sports protective head gear is of similar composition often with a hard, opaque helmet-like covering. The drawbacks of foam and similar shock absorbing materials are twofold. Firstly, they are opaque to light and secondly, they absorb forces in virtually one direction; said direction being the direction of the incidence force, the direction of the blow. In sports such as boxing and quarterbacking, or in aerial combat, it is most desirous to perceive the oncoming attack with an optimum of peripheral vision. The state of the art boxing head and football gear greatly impairs the peripheral vision of the wearer; in fact it is the primary reason that there is such great resistance of professional fighters to the wearing of head gear during actual contests. The participant can get hit needlessly while wearing the state of the art gear. This same head gear, because of its virtually unidirectional absorption of the blow, does not dissipate force with optimum efficiency. It is well known with the use of air bags in cars and water bumpers that a fluid can dissipate force in a very efficient manner.

SUMMARY OF THE INVENTION

An object of the invention is to provide a protective headgear that will allow for the passage of light through said headgear.

Another object of the invention is to provide a transparent headgear that will allow the wearer to look through the headgear as it covers the wearer in a protective manner.

Another object of the invention is to provide a clear fluid or gel to be contained within the bag like means.

Another object of the invention is to provide a tinted transparent fluid within a bag like means.

Another object of the invention is to provide a one-way valve system within the bag like means.

Another feature of the invention is to provide a demand valve system that opens and closes progressively in relation to the fluid pressures exerted on the valves.

Another feature of the invention is to provide a two-way valve.

Another essential feature of the invention is to provide pressure sensitive transducers to record a specific pressure pulse.

Another essential feature of the invention is to provide a digitalizing microcomputer to broadcast a pressure pulse received from pressure transducers.

Another object of the invention is to provide a radio transmitter linked to a microcomputer to broadcast the registered pressure flux.

A still further object of the invention is to provide a radio receiver to record the blow and its strength.

Another object of the invention is to provide a light indicator.

Another object of the invention is to provide an audio indicator.

Another object of the invention is to provide an indicator dye within the headgear's valve system that will give a visual indication of a blow scored upon said headgear.

Another feature of the invention is to provide a disposable portion of the headgear.

DETAILED DESCRIPTIONS OF THE INVENTION

Figure 1:
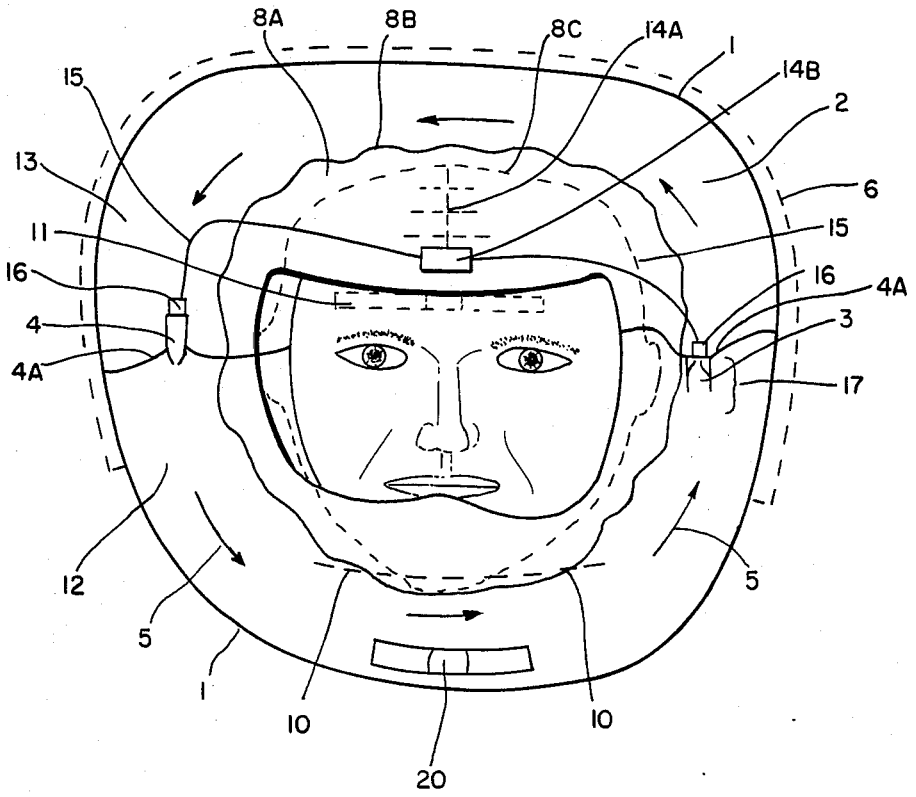
FIG. 1 is a front view of the fluidic headgear.
Figure 2:
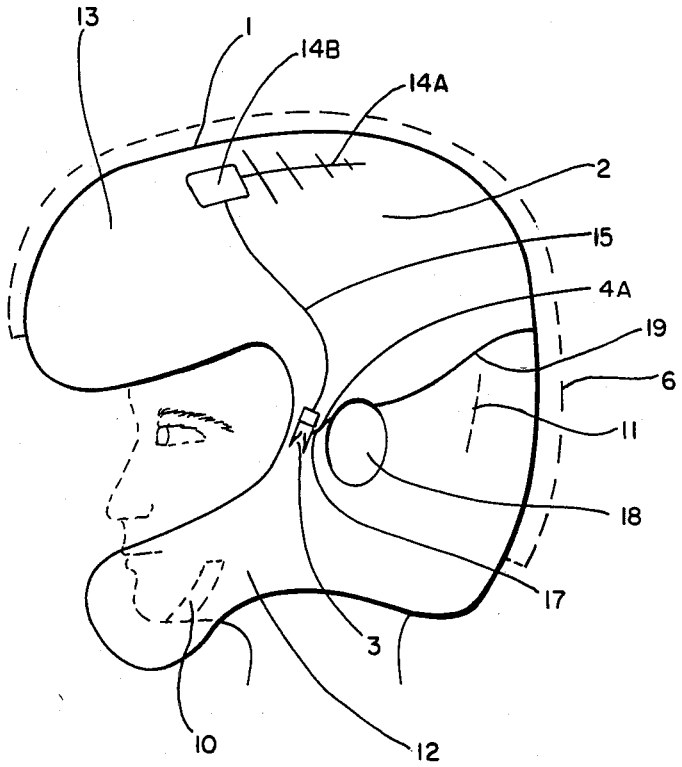
FIG. 2 is a side view of the fluidic headgear.

In its simplest version the fluidic bag helmet would consist of a container (1) composed of a pliable clear transparent material such as any of a number of tough transparent plastic materials for example, mylar, said pliable container, containing a suitable clear fluid (2). Fluid (2) would have to be transparent or at least translucent while also being inexpensive. Such a fluid could be air, water or a gel. The fluid or gel could be tinted to reduce glare. Open area (9) would fit over the face of the wearer. An internal chin strap or elastic (10) could be used to affix the helmet to the wearer's head. In a more complex version of the helmet, the head (7) including the chin and the selected areas of the face, but excluding the eyes, ears, nose, and mouth, would be against a pliable member (8C) containing a thixotrop (8A). Thixotrop (8A) could be the rare earth bentonite utilized in ski boots. The thixotrop would be separated from the surrounding protective fluid by pliable layer (8B). The purpose of the fixotrop would be to allow the headgear to conform to the contours of the individual's face. An optional hard outer layer (6), for sports other than boxing, for example football, made of a transparent plastic such as the bullet resistant materials e.g. Kevlar could be used only over the back and tip of the helmet or over the entire headgear as an added protection against piercing of the fluidic member by hard and sharp objects. A similar strap (11) as in chin strap member (10) could be used over the occipital region to make the headgear more stable. A conventinal buckle member (20) could be used to further stabilize the headgear. Member (18) is an earhole fashioned within the pliable member (1). A valve system can be located in any location to separate the fluid into at least two compartments. The simplest arrangement would have only one compartment with a single valve to measure the internal flux of pressure. In one embodiment of the invention there are two or more compartments within the fluidic bag member (1), separated by internal wall (19) into an upper (13) and lower (12) sections seen in FIG. 1, or into left and right hemispheres. They communicate through isthmus (4A) of wall (19) by valves (3) and (4). Valve (4) can be a demand valve that responds to increases and decreases in pressure opening and closing progressively to increase and decreases respectively. The valves can also be one or two way. Valve (3) depicts a oneway valve that allows fluid or gel to flow only in one direction as depicted by the arrows (5). If oneway valves are used then all the valves would have to be set in the same direction so that the fluid or gel can equalize to ambient pressure. Both valve types can have a minimum pressure threshold for activation, for example 100 pounds per square inch.

The fluid bag (1) is filled to a capacity that allows for compression and diffusion of the blow so that at the end point of the blow there is still some fluid left between the outer bag member (1) and the inner section of bag member (1) or bag extension (8B) that forms the outer container of the fixotrop.

Figure 3:
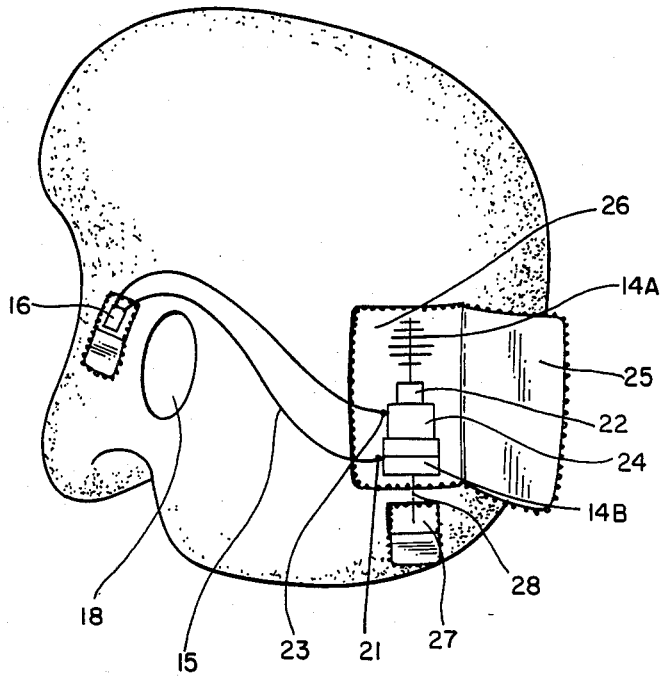
FIG. 3 is a perspective posterior view.

The valves serve as a safety net to further dissipate a blow delivered to one compartment by opening at a specific pressure as mentioned above. The valves serve yet another function, and that is to monitor the force of the blow delivered. A pressure sensitive transducer (16), which can be placed anywhere within the fluid or gel, records pressure changes while in circuit with a digitizing microcomputer incorporated with the transducer, the digitalized impulse is transmitted via wires (15) to the transmitter and battery packet (14B) and antenna (14A) to a receiver operated by ringside judges and physicians, or to the team doctor in the case of football. This on going monitoring will be a most useful safety measure as well as judging instrument. The transmission could also be made into a permanent record for quantifying the cumulative force of the blows. This could be done by computer and graphing devices. Disposable headgear, FIG. 3, could be fabricated with a recess (26) in the back or top of the head gear into which the non-disposable antenna (14A), micro computer (24), transmitter (22) and power pack (14B) is placed and connected to transducer (16) by wires (15) and connectors (21) and (23). The non-disposable portions can be secured in the recess by appropriate fastening means such as velcro, or zippered in as depicted in FIG. 3, by flap (25). The transducer (16) could be similarly deployed and fastened in a recess to be removed after the contest when the bag like portion is disposed of.

Following Paschall's Principle concerning containerized fluid, the pressure should be exerted equally in all directions and therefore the pressure should cause an equal redistribution of the fluid. If in practice the redistribution is not perfectly attained, or is attained at too slow a rate, then an internal pump means (27) attached to battery source (14B) by wires (28) would go into effect until the pressure on all transducers is equal. In this usage the transducer should be sensitive enough to register these small pressures as well as the large pressure flux of a blow. The valve chamber can have an internal isthmus (17), through which the fluid will flow. The isthmus can be filled with a fluid dye or be made of a material that contains a dye that comes off on vigorous contact with the fluid passing through the valve. This feature of the invention gives a visual means for the judges, referees and coaches to ascertain the strength and general accumulation of blows to a boxers head. This feature could be used in several ways. One way would be to place a valve that activates only at dangerous levels, spilling dark dye into the fluidic chambers of the headgear thus indicating that the fight should be stopped. Another way would be the utilization of a light colored dye that would squirt into the fluidic chambers for every head blow exceeding a given valve threshold. This threshold could be at very low value, for example 5 pounds per square inch, and could be varied for different weight classes and age groups. If the sport evolves into a fencing type contact then the radio transmitter could still be used or it could be replaced by a buzzer or other audio means and/or a light bulb to indicate a blow has scored. In the previous example the cumulative scoring of one opponent upon the other would be a progressively darkening fluid. This feature would help officials to score a fight as well as ascertain when a fighter has received enough head punches.

From the foregoing description, one skilled in the art can easily ascertain the essential characteristics of this invention and without departing from the spirit and scope thereof can make various changes and modifications of the invention to adopt to its various uses.

What is claimed is:

1. A head gear apparatus comprising a transparent pliable bag means containing a transparent fluid, a valve means within said bag means, said valve means capable of allowing said fluid to pass through a pressure sensitive transducer within said bag means to register pressure induced on said containerized fluid by an external blow on said bag means, a power source means connected to said transducer, a microprocessor means, a transmitter means, two or more separate compartments in said bag means that are contiguous through said valve means, and a fluid dye means within an isthmus holding the valve means.

2. The apparatus of claim 1, that has a dye incorporated into material of which said isthmus is made.

3. The apparatus of claim 1, that has valves that admit fluid in only one direction.

4. The apparatus of claim 1, that has valves that admit fluid in both directions.

5. The apparatus of claim 1, that has valves that respond to demand.

6. The apparatus of claim 1, that further comprises a light means electronically connected to the transducer and power source.

7. The apparatus of claim 1, that further comprises an buzzer means electronically connected to the transducer and power source.

8. The apparatus of claim 1, that has a receiver means that registers the transmission sent by said apparatus.

9. The apparatus of claim 1 that contains a gel.

10. The apparatus of claim 1 that further comprises an inner most layer that contains a thixotropic material.

11. A process wherein the force of a blow is dissipated through a fluid or gel contained within a transparent pliable bag means, wherein pressure on said fluid or gel activates a valve means, said valve means affixed at a specific threshold pressure, and wherein a pressure sensitive transducer means send impulses to a microcomputer that digitizes the pressure impulse, wherein the digitized recording is transmitted to a receiver monitored by officials.

12. The process of claim 11, wherein a dye is released into the transparent pliable bag means by the flow of fluid or gel in response to the force of a blow.

* * * * *